US005840173A

United States Patent [19]

Waldmann

[11] Patent Number: 5,840,173

[45] Date of Patent: Nov. 24, 1998

[54] PROCESS FOR TREATING THE SURFACE OF MATERIAL OF HIGH-GRADE STEEL

[75] Inventor: Ralf Waldmann, Rüscheid, Germany

[73] Assignee: Keramchemie GmbH, Siershahn, Germany

[21] Appl. No.: 873,482

[22] Filed: Jun. 12, 1997

[30] Foreign Application Priority Data

Jun. 19, 1996 [DE] Germany ..... 196 24 436.6
May 21, 1997 [DE] Germany ..... 197 21 135.6

[51] Int. Cl.[6] ..... C23G 1/08; C25F 1/06

[52] U.S. Cl. ..... 205/705; 205/710; 205/714; 205/717; 205/723; 205/741

[58] Field of Search ..... 205/705, 710, 205/714, 717, 723, 741

[56] References Cited

U.S. PATENT DOCUMENTS 4,388,169 6/1983 Nagira et al. ..... 204/207
5,332,446 7/1994 Didier et al. ..... 134/3
5,472,579 12/1995 Mabuchi et al. ..... 205/709

*Primary Examiner*—Arun S. Phasge
*Attorney, Agent, or Firm*—Friedrich Kueffner

[57] ABSTRACT

A process for treating the surface of material composed of high-grade steel, particularly strip-shaped material, wherein the material is treated with a pickling solution in a least one container and is subsequently rinsed. The solution used as the pickling solution contains a hydrochloric acid as the only acid and the material to be treated is subjected in at least one container to a least one spray treatment with the pickling solution containing the hydrochloric acid.

15 Claims, 1 Drawing Sheet

PROCESS FOR TREATING THE SURFACE OF MATERIAL OF HIGH-GRADE STEEL

BACKGROUND OF THE INVENTION

1. Field of the Invention

The present invention relates to a process for treating the surface of material composed of high-grade steel, particularly strip-shaped material, wherein the material is treated with a pickling solution in a least one container and is subsequently rinsed.

2. Description of the Related Art

High-grade steels, i.e., stainless steels or rust-resisting alloy steels, must have a metallic clean surface with low peak-to-valley height in order to achieve an optimum chemical resistance. In order to achieve this, scale layers and temper colors formed during shaping or heat treatment must be removed because the scale layers and temper colors impair the formation of a corrosion-inhibiting passive layer. Also in the case of high-grade steels, the scale layers and temper colors are removed by a pickling process. However, in such a pickling process it must be taken into consideration that the basic metal is relatively resistant to an acid attack and that, in the case of a stronger attack of the acid, the surface is not removed uniformly, but rather the surface is removed to a greater extent at certain locations. The scale layer present on the base metal adheres relatively strongly to the base metal and, therefore, it is significantly more difficult to remove the scale and the scale layer can only be removed with greater effort.

Moreover, in the case of high-grade steels, it must be taken into consideration that, in addition to iron oxides, the scale layer also contains oxides of the alloy metals and mixed oxides. Moreover, it must be taken into consideration that the structural state is also significant for the capability of pickling high-grade steels, wherein the structural state may be austenitic, ferritic, martensitic, austenitic-ferritic and ferritic-martensitic. Taking into consideration these aspects, a strip of high-grade steel is initially mechanically descaled by a blasting and brushing process. Subsequently, depending on the structural state, the strip is pickled in several containers with different pickling solutions, such as, sulfuric acid, hydrofluoric acid and additions without nitric acid, mixed acid (mixture of hydrofluoric acid and nitric acid) or in electrolytical baths containing nitric acid or neutral salts. After the strip of high-grade steel has been sufficiently rinsed, the strip is passivated.

Because of the type of pickling solutions used, the pickling of material composed of high-grade steel is relatively complicated. This is also true for the processing or regeneration of used pickling solutions. Moreover, it must be taken into consideration that the processing or regeneration of the pickling solutions produces sludge which requires expensive depositing space. Furthermore, the pickling methods used for pickling high-grade steel do not operate without producing waste water.

SUMMARY OF THE INVENTION

Therefore, it is the primary object of the present invention to provide a process for treating the surface of material composed of high-grade steel, particularly strip-shaped material, which does not require a mechanical pretreatment, is carried out with a relatively inexpensive acid having a particularly good capability of being regenerated, and which operates without producing waste water. However, it should also be ensured that the pickling process does not produce roughness values of greater than 3 $\mu$m.

In accordance with the present invention, in a process of the above-described type, a solution is used as the pickling solution which contains a hydrochloric acid as the only acid and the material to be treated is subjected in at least one container to a least one spray treatment with the pickling solution containing the hydrochloric acid.

While hydrochloric acid is generally known to be used as a pickling solution, it has in the past not been used for pickling high-grade steel. The reason for this is that when high-grade steel is pickled with hydrochloric acid there is the danger of the so-called crevice and/or intercrystalline corrosion because the chlorides produced by the process normally attack the high-grade steel.

However, extensive tests have shown that this danger does not exist in the process according to the present invention. The efficiency of spray pickling with a solution containing exclusively hydrochloric acid as the acid is relatively high. The spraying process produces an especially smooth surface of the material being treated, wherein the roughness does not exceed 3 $\mu$m. The pickling solution containing exclusively hydrochloric acid as the acid is relatively inexpensive, can be regenerated well and makes possible a surface treatment which does not produce waste water.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
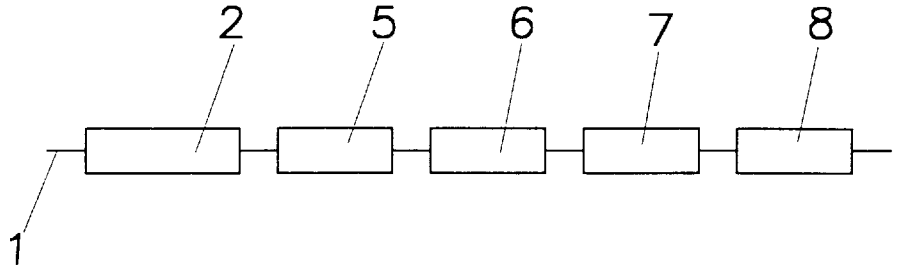
FIG. 1 schematically shows a plant for carrying out the process according to the present invention.

The drawing schematically shows a plant for carrying out a surface treatment of a strip 1 composed of high-grade steel. The strip 1 is either supplied directly from a rolling train or is uncoiled from a coil, not shown. In the illustrated embodiment, the strip 1 is initially conducted through a treatment container 2 in which the strip is electrolytically pickled by means of a solution containing hydrochloric acid as the only acid. The electrolytic pickling step can be called a type of prepickling, so that mechanical descaling carried out in the past can be omitted.

Figure 2:
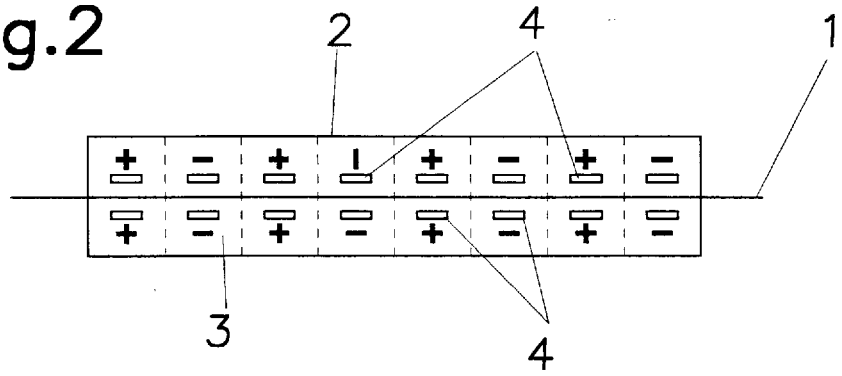
FIG. 2 is a schematic illustration of a treatment container.
Figure 3:
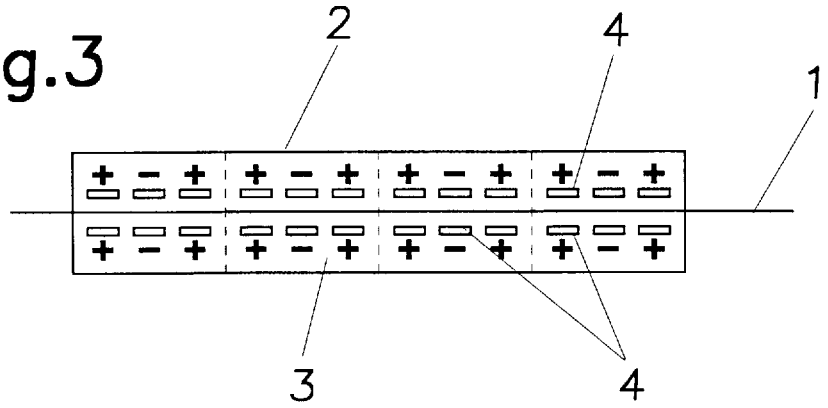
FIG. 3 is a schematic view showing another embodiment of the treatment container.

FIGS. 2 and 3 of the drawing schematically show the treatment container 2 on a larger scale.

In accordance with FIG. 2, the treatment container 2 includes several compartments or electrolysis cells 3 with individual electrodes 4, wherein the compartments or cells 3 are arranged one behind the other. The individual electrodes 4 in the successively arranged electrolysis cells 3 alternatingly form the anode and the cathode, while the strip 1 travelling through the electrolysis cell 3 alternatingly constitutes the cathode and the anode; in other words, an alternating cathodic and anodic pickling takes places. By using conventional pole changing switches or pole reversing switches, the polarity of the electrodes 4 of the successive compartments or electrolysis cells 3 can be changed as required within relatively short periods of time, for example, within one to two seconds.

FIG. 3 of the drawing shows the treatment container 2 in which pickling is carried out using the so-called middle conductor method. In this case, the treatment container 2 is also divided into individual electrolysis cells 3 or compartments with an alternating arrangement of cathodes and anodes. This also has the result that the steel strip 1 is subjected to a repeated change of the polarity as the steel strip 1 travels through the container, so that the enrichment with hydrogen and the attendant pickling brittleness are avoided. The release of chlorines is prevented by the alternating polarity of the electrodes.

In the embodiment of FIG. 2 as well as in the embodiment of FIG. 3, the treatment container 2 is filled with a pickling solution which contains exclusively hydrochloric acid as the acid, wherein the pickling solution contains approximately 70 to 140 grams, advantageously about 90 to 120 grams, free hydrochloric acid per liter of pickling solution. The temperature of the pickling solution is about 50° C. to 95° C., preferably about 70° C. to 85° C. In the case of electrolytic treatment, the current density is about 3 to 40 $A/dm^2$, advantageously about 20 $A/dm^2$. The pickling solution acting as electrolyte should have an iron chloride content of about 30 to 200 grams per liter.

Following the treatment container 2, the steel strip 1 travels through another treatment container 5 which is constructed as an immersion pickling container and which also contains a pickling solution exclusively composed of hydrochloric acid. It is advantageous in this case if the pickling solution is conducted in a counter-current flow to the direction of movement of the steel strip 1. In the treatment container 5, the pickling solution also has approximately the same concentration and the same temperature as in the treatment container 2. If necessary, another treatment container, not shown, can be arranged between the treatment containers 2 and 5. A so-called spray treatment container 6 is arranged following the treatment container 5. The additional treatment container between the treatment containers 2 and 5 is also constructed as a spray treatment container 6.

In the treatment container 6 following the treatment container 5, the steel strip 1 is sprayed under pressure with a pickling solution which also exclusively contains hydrochloric acid. The pickling solution sprayed at the steel strip 1 in the treatment container 6 is identical to the pickling solutions in the treatment containers 2 and 5.

Following the treatment container 6, the steel strip 1 travels through a rinsing container 7 in which residual chlorides still present on the steel strip 1 are removed. Advantageously, fully desalted water is used in the rinsing container 7. The rinsing container 7 can be constructed either as an immersion container and/or a spray container.

Following the rinsing container 7, the steel strip 1 is additionally conducted through a passivating plant 8 in which preferably hydrogen peroxide is applied to the steel strip 1. Thereafter, it is only necessary to dry the steel strip 1.

In accordance with a modified embodiment, only one spray treatment of the steel strip 1 is carried out in at least one container 6. This spray treatment may additionally be combined either with only one immersion treatment or only one electrolytic treatment. If necessary, following the spray treatment in accordance with the embodiment described above, an additional immersion treatment can be carried out, wherein this immersion treatment may be followed by another spray treatment.

While specific embodiments of the invention have been shown and described in detail to illustrate the inventive principles, it will be understood that the invention may be embodied otherwise without departing from such principles.

I claim:

1. A process for surface treatment of material consisting of high-grade steel, the process comprising the steps of subjecting the material to at least one spraying treatment with a pickling solution in at least one treatment vessel, wherein the pickling solution contains hydrochloric acid as a sole acid, and subsequently rinsing the material.

2. The process according to claim 1, comprising electrolytically treating the material prior to the spray treatment.

3. The process according to claim 2, comprising treating the material in a container between pairs of electrodes which essentially alternate as anodes and cathodes.

4. The process according to claim 3, comprising carrying out a pole reversal of the pairs of electrodes acting on the material within two seconds.

5. The process according to claim 3, wherein the electrodes are supplied with direct current for effecting a center conductor method.

6. The process according to claim 3, wherein the pickling solution forming an electrolyte contains about 30 to 200 grams iron fluoride per liter.

7. The process according to claim 2, comprising carrying out electrolytic pickling with a current density of about to 3 to 40 $A/dm^2$.

8. The process according to claim 1, comprising subjecting the material to an immersion treatment at least one of prior to and after the spray treatment.

9. The process according to claim 8, comprising conducting the pickling solution at least substantially in a counter-current flow during the immersion treatment of the material.

10. The process according to claim 1, wherein the pickling solution contains about 70 to 140 grams free hydrochloric acid per liter of pickling solution.

11. The process according to claim 1, wherein the pickling solution has a temperature of about 50° C. to 90° C.

12. The process according to claim 1, comprising carrying out rinsing of the material following a last pickling container using fully desalted water.

13. The process according to claim 1, comprising passivating the material following rinsing of the material.

14. The process according to claim 13, comprising carrying out passivating of the material with hydrogen peroxide.

15. The process according to claim 1, wherein the material is a strip-shaped material.

* * * * *